United States Patent [19]

Kuykendall

[11] Patent Number: 5,074,070

[45] Date of Patent: Dec. 24, 1991

[54] MAGAZINE LOADING DEVICE

[76] Inventor: Gale Kuykendall, Rte. 1, Box 352, Cohasset, Minn. 55721

[21] Appl. No.: 581,451

[22] Filed: Sep. 12, 1990

[51] Int. Cl.[5] ..... F41A 9/83

[52] U.S. Cl. ..... 42/90

[58] Field of Search ..... 42/87, 88, 90; 86/47

[56] References Cited

U.S. PATENT DOCUMENTS

| | | | |
|---|---|---|---|
| 2,466,017 | 4/1949 | Farber | 42/90 |
| 2,864,193 | 12/1958 | Drew | 42/87 |
| 3,509,655 | 5/1970 | Wilhelm | 42/87 |
| 4,464,855 | 8/1984 | Musgrave | 42/87 |
| 4,570,370 | 2/1986 | Smith et al. | 42/90 |
| 4,570,371 | 2/1986 | Mears | 42/87 |
| 4,574,511 | 3/1986 | Csongor | 42/87 |
| 4,689,909 | 9/1987 | Howard | 42/87 |
| 4,706,402 | 11/1987 | Csongor | 42/87 |
| 4,719,715 | 1/1988 | Howard | 42/87 |
| 4,799,323 | 1/1989 | Musgrave | 42/90 |
| 4,827,651 | 5/1989 | Conkey | 42/87 |
| 4,829,693 | 5/1989 | Holmes | 42/87 |
| 4,872,279 | 10/1989 | Boat | 42/90 |

*Primary Examiner*—Stephen C. Bentley

*Attorney, Agent, or Firm*—Peterson, Wicks, Nemer & Kamrath

[57] ABSTRACT

Devices (10, 10') for loading ammunition into a magazine (14) of a pistol (12) are disclosed including a cavity (54) formed in a panel (34) for slideable receipt of the depression knob (28) of the magazine slide (24) or including a retractable knob (54') for slideable receipt in a cavity (28') of the magazine slide (24). By moving the device body (32) relative to the magazine (14) when the magazine slide (24) is removably attached to the device body (32), the slide (24) will move against the bias of the magazine spring (26). When the magazine (14) is in a loading position relative to the device body (32), a retaining clip (38) is pivoted to engage the base (22) of the magazine (14) and hold the magazine (14) in the loading position. In the most preferred form, the device body (32) is in the shape of a grip for the pistol (12) to allow loading of the magazine (14) held in the loading position relative to the grip while holding the pistol (12). In the preferred form, the retaining clip (38) is retractable into the device body (32) by slideably mounting the retaining clip (38) in a cavity (40) between a first, inner position and a second, outer position. The knob (54') is retractable into the device body (32) between a first, stowed position and a second, outer position by movement of a cam (80) secured to the retaining clip (38) as the retaining clip (38) is moved between its inner and outer positions.

30 Claims, 2 Drawing Sheets

MAGAZINE LOADING DEVICE

BACKGROUND

The present invention generally relates to devices for allowing loading of ammunition into the magazine of weaponry, and in the most preferred form of handguns.

Many automatic weapons utilize removable magazines which hold a multiple of rounds of ammunition. Such magazines include biased slides which push the rounds of ammunition to an open end of the magazine for access by the weaponry. It is then necessary to depress such biased slides when loading ammunition into the magazine. Many such magazines include depression knobs formed on the slide which may be manually depressed such as by pushing by the thumb. Often the slide is depressed by pushing the knob against the bottom surface of a table or the like. But whether pushed by the thumb or a table surface, it is generally necessary to utilize both hands to load the magazine, thus requiring that the weaponry be set down while the magazine is being loaded. Auto-loaders also exist which allow rounds of ammunition to be injected into the magazine. But such auto-loaders typically are not taken into the field because of their size, thus requiring the user to possess several magazines which are preloaded with the anticipated number of rounds of ammunition to be utilized prior to going out into the field. Thus, a need exists for loading devices which may be taken out into the field and which allow ease of magazine loading. This need is especially great for small caliber handguns which are often utilized for target shooting where a large number of rounds of ammunition are expended and which are often utilized in field conditions where tables or the like and auto-loaders are not easily accessible. Further, a need exists for loading devices which do not require the weaponry to be set down while loading the magazine. This need is especially great where magazine loading occurs under field conditions as support surfaces upon which weapons may be set down may not be readily available.

SUMMARY

The present invention solves these needs and other problems in the field of loading ammunition into magazines of weaponry by providing, in the most preferred form, a loading device comprising a device body movable relative to a magazine and including a member for removable attachment to the magazine slide to move the slide against its bias into the magazine when the device body is moved relative to the magazine, and comprising a retaining clip for removably holding the magazine in a loading position relative to the device body, with the retaining clip being slideably mounted in the device body between inner and outer positions.

In a preferred aspect of the present invention, the device body is in the shape of a grip for a handgun to allow loading of the magazine held in the loading position relative to the grip while holding the handgun.

In a further preferred aspect of the present invention, the member for removable attachment to the magazine slide is in the form of a knob which extends through an elongated slot in the magazine and is slideably received in a cavity formed in the magazine slide, with the knob being movable between a first, stowed, unobstructing position and a second, outer, operative position.

It is thus an object of the present invention to provide a novel device for allowing loading of ammunition into the magazine of weaponry.

It is further an object of the present invention to provide such a novel magazine loading device for handguns.

It is further an object of the present invention to provide such a novel magazine loading device which does not require the weaponry to be set down.

It is further an object of the present invention to provide such a novel magazine loading device allowing loading of the magazine while the weaponry is being held.

It is further an object of the present invention to provide such a novel magazine loading device allowing ease of loading under field conditions.

It is further an object of the present invention to provide such a novel magazine loading device which holds the magazine slide in a depressed position while loading the magazine.

It is further an object of the present invention to provide such a novel magazine loading device of a simple design which may be easily manufactured.

It is further an object of the present invention to provide such a novel magazine loading device which is incorporated into the grip of a handgun.

It is further an object of the present invention to provide such a novel magazine loading device which does not provide physical obstruction when not in use.

It is further an object of the present invention to provide such a novel magazine loading device including a retractable knob for engaging the magazine slide.

These and further objects and advantages of the present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figures 1, 2, 3, 4, 5:
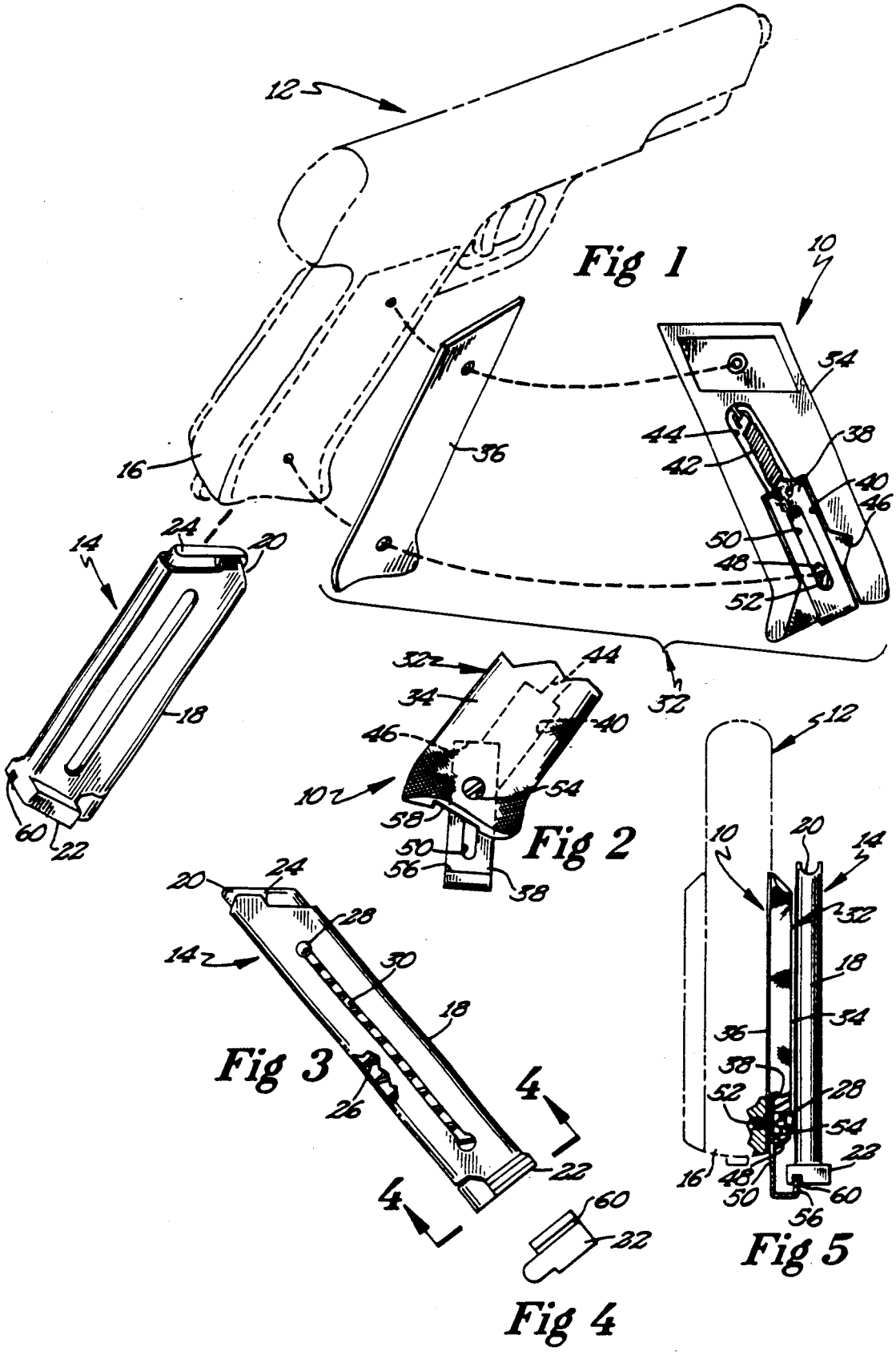
FIG. 1 shows an exploded, perspective view of a device for allowing loading of ammunition into the magazine of a handgun according to the preferred teachings of the present invention.
FIG. 2 shows a partial, side view of the magazine loading device of FIG. 1.
FIG. 3 shows a side view of the magazine of the handgun of FIG. 1.
FIG. 4 shows a bottom view of the magazine of FIG. 3 taken along view line 4—4 of FIG. 3.
FIG. 5 shows a rear view of the magazine loading device of FIG. 1, with the handgun being shown in phantom.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "end", "longitudinal", "upper", "lower", "inner", "outer", and similar terms are used herein, it should be understood that these terms have reference only to the structure shown in the drawings as it would appear to a person viewing the drawings and are utilized only to facilitate describing the invention.

DESCRIPTION

A device for allowing loading of ammunition into the magazine of weaponry is shown in its most preferred form in FIGS. 1–5 of the drawings and generally designated 10. Specifically, in the most preferred form, device 10 is disclosed in use with a semi-automatic pistol or handgun 12 having a magazine 14 slideably received in handle or grip frame 16. Generally, magazine 14 includes an elongated, hollow sleeve 18 for slideable receipt of shells in a stacked, parallel arrangement through an open upper end 20. The lower end of sleeve 18 is closed by a base 22. A slide 24 is slideably moveable within sleeve 18 and biased toward open end 20 by a spring 26 sandwiched between slide 24 and base 22. Provisions 28 are further provided to manually depress slide 24 within sleeve 18 and against the bias of spring 26 to allow dropping of shells through open end 20 into sleeve 18 and without requiring the shells to push slide 24 against the bias of spring 26. In the most preferred form, provisions 28 are shown as a depression knob secured to slide 24 and extending through an elongated longitudinal slot 30 formed in the sides of sleeve 18 of magazine 14.

Device 10 in the most preferred form includes a body 32 including a panel 34 and a flat, planar cover or backing plate 36 having a shape and size complementary to and for securement to panel 34. Device 10 further includes a retaining clip 38 slideably mounted and received in body 32 between a first, retracted, inner position as shown in FIG. 1 located generally within body 32 and a second, extended, outer position as shown in FIG. 5 extending outside of body 32. In the preferred form, retaining clip 38 is slideably mounted in body 32 by a cavity 40 formed by a recess cast in panel 34 of a size for slideable receipt of retaining clip 38 and which is closed by cover 36. Retaining clip 38 is biased from its second, outer position to its first, inner position in the most preferred form by a retracting spring 42. Spring 42 is located in a cavity 44 formed by a recess cast in panel 34 and extending longitudinally from the inside edge of cavity 40 and which is also closed by cover 36. The opposite ends of spring 42 are anchored to panel 34 inside of cavity 44 and to retaining clip 38. Cover 36 keeps retaining clip 38 and spring 42 from catching on the grip frame 16 of pistol 12.

Device 10 further includes provisions for selectively holding retaining clip 38 in a third, extended, outer, stationary position and against movement by the bias of spring 42. In the most preferred form, a cavity or locking notch 46 is formed by a recess cast in panel 34 intersecting with cavity 40 at an obtuse angle adjacent its outer end and of a size and shape for slideable receipt of retaining clip 38 and which is also closed by cover 36.

Device 10 further includes a pivot member in the form of a generally oval shaped washer 48 pivotally mounted in body 32 within the intersection of cavities 40 and 46 and which is slideably mounted in an elongated slot 50 formed in retaining clip 38. In the most preferred form, washer 48 is pivotally received on a screw 52 extending through panel 34 and cover 36 and threadably received in pistol 12. Retaining clip 38 is pivotal about washer 48 between its second and third, outer positions. It can then be appreciated that washer 48 also prevents the collapse of cavities 40 and 46 when screw 52 is tightened down in pistol 12, with the oval shape maximizing the surface support area while minimizing the width across slot 50.

Device 10 further includes provisions 54 for engaging slide manually depressing provision 28 of magazine 14. In the most preferred form, provisions 54 are shown as a cavity 54 of a size and shape complementary to and for slideable receipt of knob 28 and formed in the outside face of panel 34 opposite to cavities 40 and 46. In the most preferred form, cavity 54 is formed contiguous with the recess cavity for screw 52 and may be reinforced to prevent deformation from multiple engagements with knob 28.

Retaining clip 38 further includes provisions 56 for abutting with and for removable securement to base 22 of magazine 12. In the preferred form, the outer end of retaining clip 38 is generally C-shaped and includes a tenon or upstanding lip 56 which extends generally parallel to the outside face of panel 34 opposite to cavities 40 and 46. In the most preferred form, the C-shaped end of retaining clip 38 has a thickness generally equal to the thickness of panel 34 between cavities 40 and 46 and the outside face of panel 34, and panel 34 may include a recess 58 formed in panel 34 for receiving the C-shaped end and lip 56 of retaining clip 38 such that the C-shaped end and lip 56 of retaining clip 38 is flush with the outside face and end of panel 34 when retaining clip 38 is in its first, inner position. Further, in the most preferred form, base 22 of magazine 14 includes a slot 60 for engaging and for removable receipt of the free end of lip 56 of retaining clip 38.

In the most preferred form, device 10 according to the teachings of the present invention is built into, formed as and incorporated into the grip of a handgun 12. However, it can be appreciated that device 10 may take other forms and configurations according to the teachings of the present invention.

Now that the basic construction of device 10 according to the preferred teachings of the present invention has been explained, the operation and subtle features of device 10 can be set forth and appreciated. An empty magazine 14 may be removed from pistol 12 in the normal manner. While pistol 12 is held by one hand of the user, retaining clip 38 may be manually pulled by the user's other hand longitudinally within cavity 40 against the bias of spring 42 from its first, inner position to its second, outer position and then pushed forward to pivot about washer 48 to its third, outer position within cavity 46 as shown in FIG. 2. It can then be appreciated that due to the angular positioning of retaining clip 38 within cavity 46, spring 42 is not able to move retaining clip 38 into cavity 40 and towards its first, inner position. Thus, retaining clip 38 remains or is selectively held in its third, outer position relative to panel 34. While pistol 12 is still being held by the user's first hand, magazine 14 held in the user's other hand may then be positioned adjacent and generally parallel to the outside face of panel 34 of body 32. Knob 28 of magazine 14 may then be positioned to extend into cavity 54 of panel 34. At that time and while pistol 12 is still being held by the user's first hand, magazine 14 may be moved upwardly by the user's other hand relative to panel 34 and parallel to the outside face of panel 34. As knob 28 received in cavity 54 is held stationary relative to panel 34 attached to pistol 12, as magazine 14 moves relative to panel 34 and pistol 12, slide 24 will slide in sleeve 18 of magazine 14 against the bias of spring 26 towards base 22. When slide 24 reaches its lowest position within body 18, lip 56 of retaining clip 38 should be at a position generally below that of base 22 of magazine 14. At that time, retaining clip 38 may be pushed to pivot about washer 48 from its third, outer position to its second, outer position as shown in FIG. 5. When retaining clip 38 is located in its second, outer position, retaining clip 38 will move towards its first, inner position under the bias of spring 26 until lip 56 abuts with base 22 of magazine 14 and is located within slot 60. It can then be appreciated that magazine 14 is then securely held to panel 34 in a loading position by knob 28 of magazine 14 received in cavity 54 of device 10 and by lip 56 of retaining clip 38 of device 10 received in slot 60 of base 22 of magazine 14, with slide 24 held adjacent its lowest, depressed position within sleeve 18. Thus, while pistol 12 including magazine 14 held in its loading position is held by the user's first hand, shells may be dropped through open end 20 of magazine 14 to load magazine 14 by the user's other hand. It can then be appreciated that loading of magazine 14 may be easily accomplished while holding pistol 12 including device 10 in one hand of the user while the shells are placed in magazine 14 with the user's other hand and without the necessity of physically holding magazine spring 26 in its depressed position while loading. Thus, it is not necessary to set down pistol 12 at a remote location when loading magazine 14 which is highly undesirable when loading occurs out in the field.

After magazine 14 is loaded with shells, magazine 14 may be pulled from the loading position adjacent panel 34 attached to pistol 12 top first away from panel 34, with base 22 pivoting about lip 56 of retaining clip 38. Thus knob 28 of magazine 14 will be pulled from cavity 54 of panel 34 and releasing slide 24 to move within sleeve 18 toward open end 20 of magazine 14. After disengagement of lip 56 from base 22 of magazine 14, retaining clip 38 will automatically move to its first, inner position as shown in FIG. 1 under the bias of spring 42 with the C-shaped end and lip 56 being received in recess 58 of panel 34. With retaining clip 38 in its first, inner position, device 10 provides no physical obstruction to the normal use of pistol 12 in a similar manner as pistols not equipped with device 10 according to the preferred teachings of the present invention.

In FIGS. 1-5, provisions 28 and 54 have been shown and explained in the preferred form as a knob and a cavity. However, such provisions may take other forms and configurations. An example of alternate forms would include a cavity formed in slide 24 of magazine 14 which may be engaged by a knob formed on panel 34 extending through slot 30 formed in sleeve 18. One such preferred form according to the teachings of the present invention is shown in FIGS. 6-9 and generally designated 10'. Specifically, provisions 28' for manually depressing the slide 24 within sleeve 18 and against the bias of spring 26 are shown as a cavity formed in slide 24 and accessible through elongated longitudinal slot 30 formed in magazine 14 by provisions 54' shown as a knob of a size and shape complementary to and for slideable receipt within cavity 28'.

Figure 7:
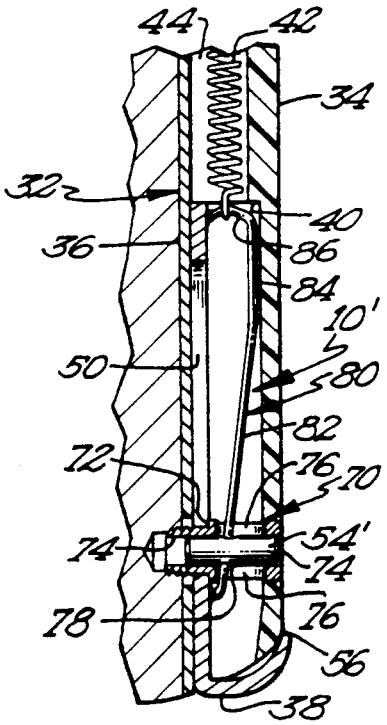
FIG. 7 shows a partial, cross-sectional view of the magazine loading device of FIG. 6 according to section line 7—7 of FIG. 6.
Figure 8:
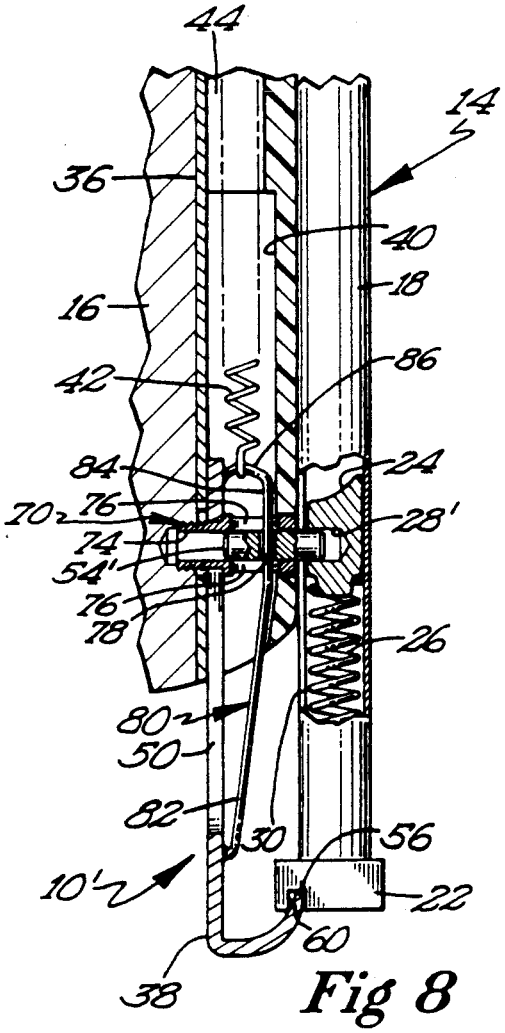
FIG. 8 shows a partial, cross-sectional view of the magazine loading device of FIG. 6 in a loading position with the magazine of the handgun.
Figure 9:
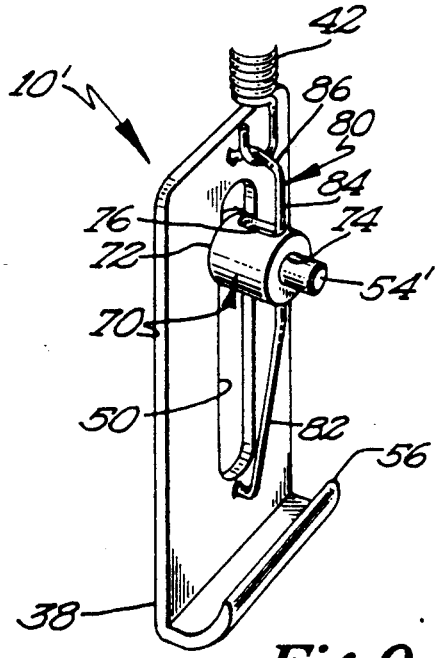
FIG. 9 shows a perspective view of components of the magazine loading device of FIG. 6.

In the most preferred form, knob 54' is slideably mounted for movement between a stowed, inner position as best seen in FIG. 7 and an outer position as best seen in FIGS. 8 and 9. In its stowed position, knob 54' provides no physical obstruction to the normal use of pistol 12 in a similar manner as pistols not equipped with device 10' according to the preferred teachings of the present invention. In its outer position, knob 54' extends beyond the outside face of panel 34 opposite to cavities 40 and 46. Particularly, in the preferred form, device 10' includes a hollow sleeve 70 having a first end threadably received in handgun 12. Sleeve 70 is located and slideably received in slot 50 of retaining clip 38 and includes a shoulder 72 for axially capturing and sandwiching retaining clip 38 against cover 36 and pistol 12. It can then be appreciated that sleeve 70 acts as a pivot member for retaining clip 38 for movement between its second and third, outer positions. Sleeve 70 has a height above cover 36 to extend to the same level as the outside face of panel 34 or to be inset therefrom. Knob 54' is in the form of a cylindrical post slideably received in internal bore 74 of sleeve 70 and has a length generally equal to the length of sleeve 70. In its stowed position, knob 54' is located within bore 74 of sleeve 70, and in its outer position, knob 54' extends out of bore 74 of sleeve 70 and beyond the outside face of panel 34.

Suitable provisions such as a camming system of the preferred form are provided for sliding knob 54' in sleeve 70. Further, in the most preferred form, knob 54' is movable between its inner and outer positions with movement of retaining clip 38 between its retracted and extended positions, respectively. Particularly, sleeve 70 includes axially extending elongated slots 76 located diametrically on opposite sides of bore 74. Knob 54' further includes a diametrically extending bore 78 extending therethrough and within the confines of slots 76 of sleeve 70 when knob 54' is slideably received in bore 74. Retaining clip 38 includes a cam 80 located above and along slot 50. Specifically, cam 80 is in the form of a pin having an inclined, ramp portion 82 extending from the outer end of retaining clip 38 adjacent to the outer end of slot 50 at an angle in the order of 15° and terminating contiguously in a flat portion 84 adjacent to the inner end of and generally parallel to slot 50 and retaining clip 38. Portion 84 in turn terminates contiguously in a front portion 86 extending generally perpendicularly between retaining clip 38 and flat portion 84. In the most preferred form, the outer end of spring 42 is anchored to front portion 86. With retaining clip 38 located in its inner position, sleeve 70 and knob 54' are positioned adjacent to the outer end of slot 50 and the initiation of ramp portion 82 and bore 78 is located in knob 54' such that knob 54' is located in its stowed position. It can then be appreciated that as retaining clip 38 is moved towards its second and third positions, bore 78 of knob 54' will move up ramp portion 82 causing knob 54' to slide within bore 74 of sleeve 70 from its stowed position towards its outer position. When retaining clip 38 is located in its second or third outer positions, bore 78 of knob 54' will be located on flat portion 84 with knob 54' located in its outer position. Due to the elongated nature of slots 76, cam 80 does not place pressure on sleeve 70 to move with knob 54'. It can be further appreciated that in moving retaining clip 38 between its second and third, outer positions, sleeve 70 and knob 54' may rotate about the threads of sleeve 70 relative to handgun 12 or slots 76 may have a width sufficient for cam 80 and knob 54' to pivot within sleeve 70.

Now that the basic construction of device 10' according to the preferred teachings of the present invention has been explained, the operation and subtle features of device 10' can be set forth and appreciated. An empty magazine 14 may be removed from pistol 12 in the normal manner. While pistol 12 is held by one hand of the user, retaining clip 38 may be manually pulled by the user's other hand longitudinally within cavity 40 against the bias of spring 42 from its first, inner position to its second, outer position and then pushed forward to pivot about sleeve 70 to its third, outer position within cavity 46 as shown in phantom in FIG. 6. It can then be appreciated that as retaining clip 38 is pulled outwardly, knob 54' will simultaneously move outwardly due to the sliding movement of cam 80 within bore 78 of knob 54' causing knob 54' to slide in sleeve 70 to its outer position as best seen in FIG. 9 when retaining clip 38 is in its second and third, outer positions. With retaining clip 38 selectively held in its third, outer position relative to panel 34 and while pistol 12 is still being held by the user's first hand, magazine 14 held in the user's other hand may then be positioned adjacent and generally parallel to the outside face of panel 34 of body 32. Knob 54' of device 10' may then be positioned to extend into cavity 28' of magazine 14. At that time and while pistol 12 is still being held by the user's first hand, magazine 14 may be moved upwardly by the user's other hand relative to panel 34 and parallel to the outside face of panel 34. Since slide 24 is held stationary relative to panel 34 attached to pistol 12 by knob 54' received in cavity 28', as magazine 14 moves relative to panel 34 and pistol 12, slide 24 will slide in sleeve 18 of magazine 14 against the bias of spring 26 towards base 22. When slide 24 reaches its lowest position within body 18, lip 56 of retaining clip 38 should be at a position generally below that of base 22 of magazine 14. At that time, retaining clip 38 may be pushed to pivot about sleeve 70 from its third, outer position to its second, outer position as shown in FIG. 8. When retaining clip 38 is located in its second, outer position, retaining clip 38 will move towards its first, inner position under the bias of spring 26 until lip 56 abuts with base 22 of magazine 14 and is located within slot 60. It can then be appreciated that magazine 14 is then securely held to panel 34 in a loading position by knob 54' of device 10' received in cavity 28' of magazine 14 and by lip 56 of retaining clip 38 of device 10' received in slot 60 of base 22 of magazine 14, with slide 24 held adjacent its lowest, depressed position within sleeve 18. Thus, while pistol 12 including magazine 14 held in its loading position is held by the user's first hand, shells may be dropped through open end 20 of magazine 14 to load magazine 14 by the user's other hand. It can then be appreciated that loading of magazine 14 may be easily accomplished while holding pistol 12 including device 10' in one hand of the user while the shells are placed in magazine 14 with the user's other hand and without the necessity of physically holding magazine spring 26 in its depressed position while loading.

Figure 6:
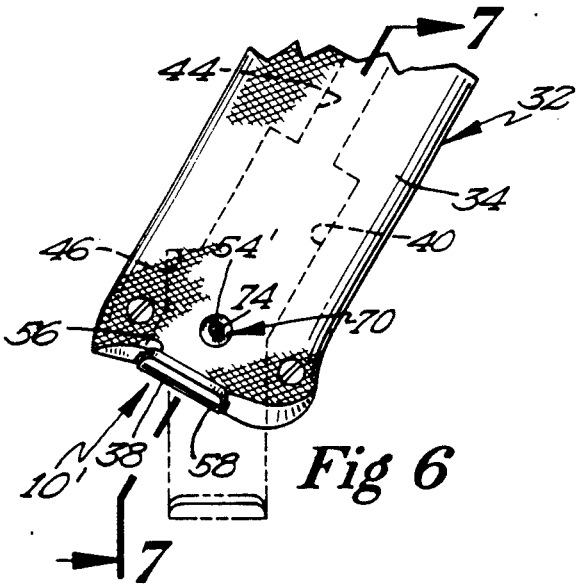
FIG. 6 shows a partial, side view of a handgun including an alternate form of a device for allowing loading of ammunition into the magazine of the handgun.

After magazine 14 is loaded with shells, magazine 14 may be pulled from the loading position adjacent panel 34 attached to pistol 12 top first away from panel 34, with base 22 pivoting about lip 56 of retaining clip 38. Thus knob 54' of device 10' will be pulled from cavity 28' of magazine 14 and releasing slide 24 to move within sleeve 18 toward open end 20 of magazine 14. After disengagement of lip 56 from base 22 of magazine 14, retaining clip 38 will automatically move to its first, inner position as shown in FIGS. 6 and 7 under the bias of spring 42 with the C-shaped end and lip 56 being received in recess 58 of panel 34. It can be appreciated that as retaining clip 38 moves inwardly under the bias of spring 42, knob 54' will simultaneously move inwardly due to the sliding movement of cam 80 within bore 78 of knob 54' causing knob 54' to slide in sleeve 70 to its inner, stowed position as best shown in FIG. 7 when retaining clip 38 is in its first, inner position. With retaining clip 38 and knob 54' in their inner positions, device 10' provides no physical obstruction to the normal use of pistol 12 in a similar manner as pistols not equipped with device 10' according to the preferred teachings of the present invention.

Now that the basic teachings of preferred forms of the present invention have been explained, many extensions and variations will be obvious to one having ordinary skill in the art. For example, although devices 10 and 10' have been shown and described in their most preferred forms for use with pistol or handgun 12, it can be appreciated that devices 10 and 10' may be utilized with other types of weaponry.

Similarly, although devices 10 and 10' have been shown and described as formed as and incorporated into the grip of pistol 12, it can be appreciated that devices 10 and 10' may be formed as and incorporated into other weaponry parts and/or may be formed independently of the weaponry. It can be further appreciated that devices 10 and 10' according to the preferred teachings of the present invention include many unique and synergistic features which are believed to be particularly advantageous. For example, a device for loading ammunition into magazine 14 may be formed according to the teachings of the present invention which does not utilize all of the features of the preferred form such as the retractable retaining clip.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. Device for allowing loading of ammunition into a magazine of a handgun, with the magazine including a hollow sleeve having an open end and a base and including a slide movable within the hollow sleeve from adjacent to the base to the open end, with the slide being biased from adjacent the base towards the open end, comprising, in combination: a device body in the shape of a grip secured to the handgun, with the hollow sleeve of the magazine being movable relative to the device body; means located on the device body for removable attachment to a portion of the slide as the hollow sleeve of the magazine is moved relative to the device body causing the slide to move within the hollow sleeve against the bias from the open end towards the base; and means formed on the device body for removably holding the hollow sleeve of the magazine in a fixed loading position relative to the handgun to allow loading of the magazine while holding the handgun.

2. The device of claim 1 wherein the removably holding means comprises, in combination: means for abutting with the base of the magazine.

3. The device of claim 2 wherein the abutting means comprises, in combination: a retaining clip for abutting with the base of the magazine; and means for slideably mounting the retaining clip between a first, inner position inside of the device body and a second, outer position extending outside of the device body.

4. The device of claim 3 wherein the abutting means comprises, in combination: means for biasing the retaining clip from its second, outer position to its first, inner position.

5. The device of claim 3 wherein the slideably mounting means comprises, in combination: a first cavity of a size and shape for slideable receipt of the retaining clip between the first, inner position and the second, outer position.

6. The device of claim 5 wherein the device body comprises, in combination: a panel; and a flat cover of a size and shape complementary to the panel, with the first and second cavities being formed by recesses formed in the panel which are covered by the flat cover, with the flat cover being sandwiched between the panel and the handgun.

7. The device of claim 1 wherein the hollow sleeve of the magazine includes an elongated slot; wherein the slide includes a cavity accessible through the elongated slot of the magazine; wherein the device body has an outside face; and wherein the removable attachment means comprises, in combination: a knob; and means for moving the knob relative to the device body between a first, stowed position and a second, outer position, with the knob in the first, stowed position providing no obstruction to the outside face of the device body, and with the knob in the second, outer position extending beyond the outside face of the device body a distance sufficient to extend through the elongated slot of the sleeve of the magazine and into the cavity of the slide of the magazine.

8. Device for allowing loading of ammunition into a magazine of weaponry, with the magazine including a hollow sleeve having an open end and a base and including a slide movable within the hollow sleeve from adjacent to the base to the open end, with the slide being biased from adjacent the base towards the open end, comprising, in combination: a device body movable relative to the hollow sleeve of the magazine; means located on the device body for removable attachment to a portion of the slide as the device body is moved relative to the hollow sleeve of the magazine causing the slide to move within the hollow sleeve against the bias from the open end towards the base; a retaining clip for abutting with the base of the magazine; and means for slideably mounting the retaining clip between a first, inner position inside of the device body and a second, outer position extending outside of the device body for removably holding the hollow sleeve of the magazine in a loading position relative to the device body.

9. The device of claim 8 further comprising, in combination: means for biasing the retaining clip from its second, outer position to its first, inner position.

10. The device of claim 9 wherein the retaining clip biasing means comprises a spring having a first end anchored to the device body and a second end anchored to the retaining clip.

11. The device of claim 9 further comprising, in combination: means for selectively holding the retaining clip in a stationary position extending outside of the device body and against movement by the biasing means.

12. The device of claim 11 wherein the selectively holding means comprises means for slideably receiving the retaining clip in a third, outer position.

13. The device of claim 12 wherein the slideably mounting means comprises, in combination: a first cavity of a size and shape for slideable receipt of the retaining clip between the first, inner position and the second, outer position; and wherein the slideably receiving means comprises, in combination: a second cavity of a size and shape for slideable receipt of the retaining clip and intersecting with the first cavity at an obtuse angle and adjacent its outer end.

14. The device of claim 13 further comprising, in combination: an elongated slot formed in the retaining clip; and a pivot member located in the slot and secured to the device body in the intersection of the first and second cavities, with the retaining clip being pivotal about the pivot member between its second and third, outer positions.

15. The device of claim 14 wherein the outer end of the retaining clip is C-shaped and includes an upstanding lip; and wherein the device further comprises, in combination: means formed on the base of the magazine for engaging the upstanding lip of the retaining clip.

16. The device of claim 13 wherein the slide of the magazine includes a depression knob; and wherein the removable attachment means comprises a cavity formed in the device body of a size and shape for slideable receipt of the depression knob.

17. The device of claim 16 wherein the device body is in the shape of a grip secured to a handgun, with the hollow sleeve of the magazine being removably held relative to the handgun to allow loading of the magazine while holding the handgun.

18. The device of claim 17 wherein the device body comprises, in combination: a panel; and a flat cover of a size and shape complementary to the panel, with the first and second cavities being formed by recesses formed in the panel which are covered by the flat cover, with the flat cover being sandwiched between the panel and the handgun.

19. The device of claim 13 wherein the hollow sleeve of the magazine includes an elongated slot; wherein the slide includes a cavity accessible through the elongated slot of the magazine; wherein the device body has an outside face; and wherein the removable attachment means comprises, in combination: a knob; a sleeve secured in the device body and having an internal bore of a size for slideable receipt of the knob; and means for moving the knob in the internal bore of the sleeve between a first, stowed position and a second, outer position, with the knob in the first, stowed position providing no obstruction to the outside face of the device body, and with the knob in the second, outer position extending beyond the outside face of the device body a distance sufficient to extend through the elongated slot of the sleeve of the magazine and into the cavity of the slide of the magazine; and wherein the device further comprises, in combination: an elongated slot formed in the retaining clip, with the sleeve located in the elongated slot of the retaining clip and secured in the device body in the intersection of the first and second cavities of the device body, with the retaining clip being pivotal about the sleeve between its second and third, outer positions.

20. The device of claim 19 wherein the knob moving means comprises, in combination: means for simultaneously moving the knob as the retaining clip is slid between the first, inner position and the second and third, outer positions.

21. The device of claim 8 wherein the outer end of the retaining clip is C-shaped and includes an upstanding lip; and wherein the device further comprises, in combination: means formed on the base of the magazine for engaging the upstanding lip of the retaining clip.

22. The device of claim 21 wherein the thickness of the C-shaped outer end of the retaining clip has a thickness generally equal to the thickness of the device body between the first cavity and the outside face; and wherein the device further comprises, in combination: a recess formed in the device body of a size and shape for receipt of the outer end of the retaining clip in the first, inner position.

23. The device of claim 8 wherein the slide of the magazine includes a depression knob; and wherein the removable attachment means comprises a cavity formed in the device body of a size and shape for slideable receipt of the depression knob.

24. The device of claim 8 wherein the hollow sleeve of the magazine includes an elongated slot; wherein the slide includes a cavity accessible through the elongated slot of the magazine; wherein the device body has an outside face; and wherein the removable attachment means comprises, in combination: a knob; and means for moving the knob relative to the device body between a first, stowed position and a second, outer position, with the knob in the first, stowed position providing no obstruction to the outside face of the device body, and with the knob in the second, outer position extending beyond the outside face of the device body a distance sufficient to extend through the elongated slot of the sleeve of the magazine and into the cavity of the slide of the magazine.

25. Device for allowing loading of ammunition into a magazine of weaponry, with the magazine including a hollow sleeve having an open end, an elongated slot, and a base and including a slide movable within the hollow sleeve from adjacent to the base to the open end, with the slide being biased from adjacent the base towards the open end and including a cavity accessible through the elongated slot, comprising, in combination: a device body having an outside face movable relative to the hollow sleeve of the magazine; a knob for removable attachment to the cavity of the slide of the magazine; and means for moving the knob relative to the device body between a first, stowed position and a second, outer position, with the knob in the first, stowed position providing no obstruction to the outside face of the device body, and with the knob in the second, outer position extending beyond the outside face of the device body a distance sufficient to extend through the elongated slot of the sleeve of the magazine and into the cavity of the slide of the magazine.

26. The device of claim 25 wherein the moving means comprises, in combination: a sleeve having an internal bore of a size for slideable receipt of the knob; and means for sliding the knob in the bore of the sleeve between the first, stowed position and the second, outer position.

27. The device of claim 26 wherein the sliding means comprises means for camming the knob.

28. The device of claim 27 wherein the camming means comprises, in combination: axially extending slots formed through the sleeve; a radial bore formed through the knob; and a camming pin movable relative to the sleeve and the knob and extending through the axially extending slots and the radial bore for moving the knob within the sleeve.

29. The device of claim 28 further comprising, in combination: a retaining clip for removably holding the hollow sleeve of the magazine in a loading position relative to the device body; and means for slideably mounting the retaining clip between a first, inner position inside of the device body and a second, outer position extending outside of the device body, with the camming pin attached to the retaining clip for simultaneously moving the knob within the sleeve as the retaining clip is slid relative to the device body.

30. The device of claim 25 wherein the device body is in the shape of a grip secured to a handgun.

* * * * *